US006792723B2

(12) United States Patent
Stegmeier, Sr. et al.

(10) Patent No.: US 6,792,723 B2
(45) Date of Patent: Sep. 21, 2004

(54) DECK DRAIN

(76) Inventors: William J. Stegmeier, Sr., 1111 W. Harris Rd., Arlington, TX (US) 76001; William J. Stegmeier, Jr., 1111 W. Harris Rd., Arlington, TX (US) 76001

( * ) Notice: Subject to any disclaimer, the term of this patent is extended or adjusted under 35 U.S.C. 154(b) by 140 days.

(21) Appl. No.: 10/020,075

(22) Filed: Dec. 13, 2001

(65) Prior Publication Data

US 2003/0111397 A1 Jun. 19, 2003

(51) Int. Cl.[7] ..... E02D 19/00

(52) U.S. Cl. ..... 52/169.5; 4/507; 52/302.3; 138/106; 210/164; 404/4

(58) Field of Search ..... 52/11, 12, 16, 52/169.5, 169.7, 302.1, 302.3; 4/506, 507, 510; 138/103, 106, 107; 210/164, 169, 435, 541; 404/2, 4

(56) References Cited

U.S. PATENT DOCUMENTS 3,546,719 A * 12/1970 Bishop ..... 4/510
4,007,566 A * 2/1977 Molitor ..... 52/169.7
4,490,067 A * 12/1984 Dahowski ..... 404/4
4,815,888 A * 3/1989 Stegmeier ..... 404/4
5,007,224 A * 4/1991 Segneri ..... 52/741.1
5,454,663 A * 10/1995 Stegmeier ..... 404/2

* cited by examiner

*Primary Examiner*—Joseph Drodge
(74) *Attorney, Agent, or Firm*—Jeffrey T. Hubbard; H. Dennis Kelly; Kelly & Hubbard

(57) ABSTRACT

A deck drain is made from extruded plastic with a cross section defining a substantially circular main channel, a mid section, and a top section having a top face with a plurality of openings defined therein. Nail guiding means are attached to the mid section, and direct a nail or screw through the mid section to secure the deck drain to a planar surface. Edges of two or more of the structural elements are aligned vertically to permit the deck drain to contact the planar surface without wobbling when attached.

10 Claims, 4 Drawing Sheets

DECK DRAIN

TECHNICAL FIELD

This invention relates in general to wastewater handling, and in particular, the invention relates to an improved deck drain pipe having features to promote simple and reliable mounting to a planar surface such as a wooden beam.

BACKGROUND OF THE INVENTION

Prefabricated plastic drain conduit is commonly used for drainage of decking around swimming pools. The typical conduit has a complex, often asymmetrical cross section that requires specialized connectors for attaching standard lengths of conduit together to span the entire length of a particular installation. To reduce the need for specialized connectors, the drain channel can be formed with a circular cross section adapted to couple with standard pipe.

When a concrete wall or other vertical surface forms the edge of a pool deck, the drain conduit is often secured to the vertical surface using concrete nails. These nails have to be driven into the concrete with greater force than nails driven into wood, which often results in cracking of the conduit, or deformation or misalignment of the conduit. Excessive deformation can lead to premature loss of the conduit's structural integrity and reduces draining capacity. Misaligned conduit forms a tripping hazard, prevents complete drainage, and is unsightly.

A need remained for a deck drain conduit that can be coupled with standard pipe, and has provisions to permit nailing the conduit to a support without unacceptable deformation or misalignment. As always, a deck drain that is reliable and long-lasting and can be made at minimal expense was also desired.

SUMMARY OF THE INVENTION

In general, a deck drain having the desired features and advantages is achieved by a main channel having a circular cross section, a top section having a top face designed to mount flush with the decking surface, and a mid section interconnecting the top section and the main channel. Nail guiding means attach to the mid section for accepting and directing a nail, preferably a concrete nail, through the mid section to secure the conduit to a support. Preferably, the nail guiding means comprises a pair of parallel planar projections extending away from the mid section, with each projection terminating at the end distal to the mid section in a flange to strengthen the projection and provide a surface for the nail head to press against.

A base plate extends out tangentially from the bottom of the main channel, allowing the conduit to stand unaided on a leveled surface. In addition, for each side of the conduit, the end of the base plate, the flanges on the nail guide projections, and a vertical wall of the top section are all aligned along a vertical axis to permit the conduit to be stably secured against a vertical surface without rocking. The base plate additionally acts as an anchor plate in installations where concrete is poured into the space on one or both sides of the conduit.

The main channel, mid section and top section are arranged along a major axis transverse to and intersecting with the main channel centerline. The advantages already discussed can be achieved with an asymmetrical conduit, i.e. one having the nail guiding means and the base plate located on only one side of the cross-sectional profile of the conduit. However, a symmetrical cross-sectional profile is preferred.

Additional features and advantages of the invention will become apparent in the following detailed description and in the drawings.

DETAILED DESCRIPTION OF THE PREFERRED EMBODIMENT

Figure 1:
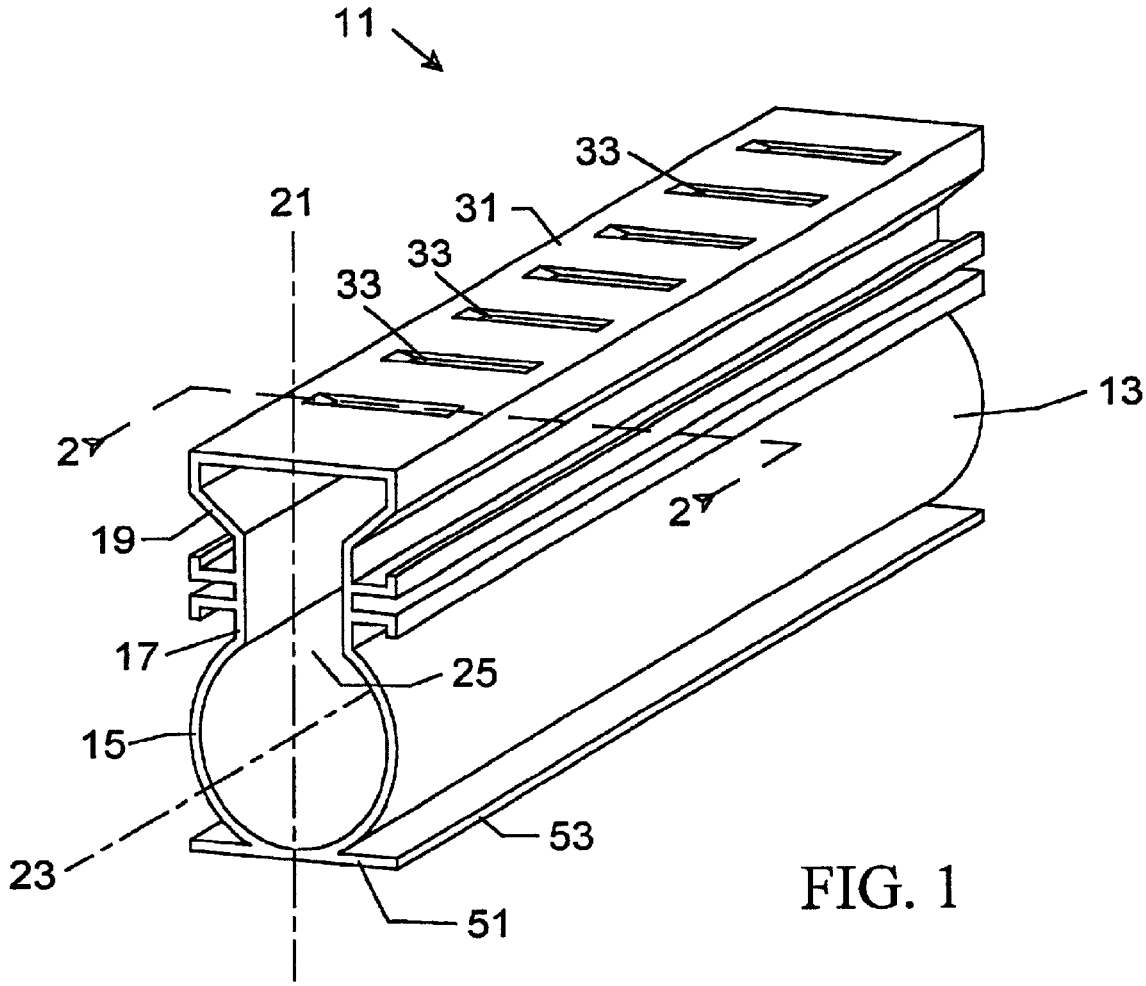
FIG. 1 is a perspective view of a section of deck drain according to the invention.
Figure 2:
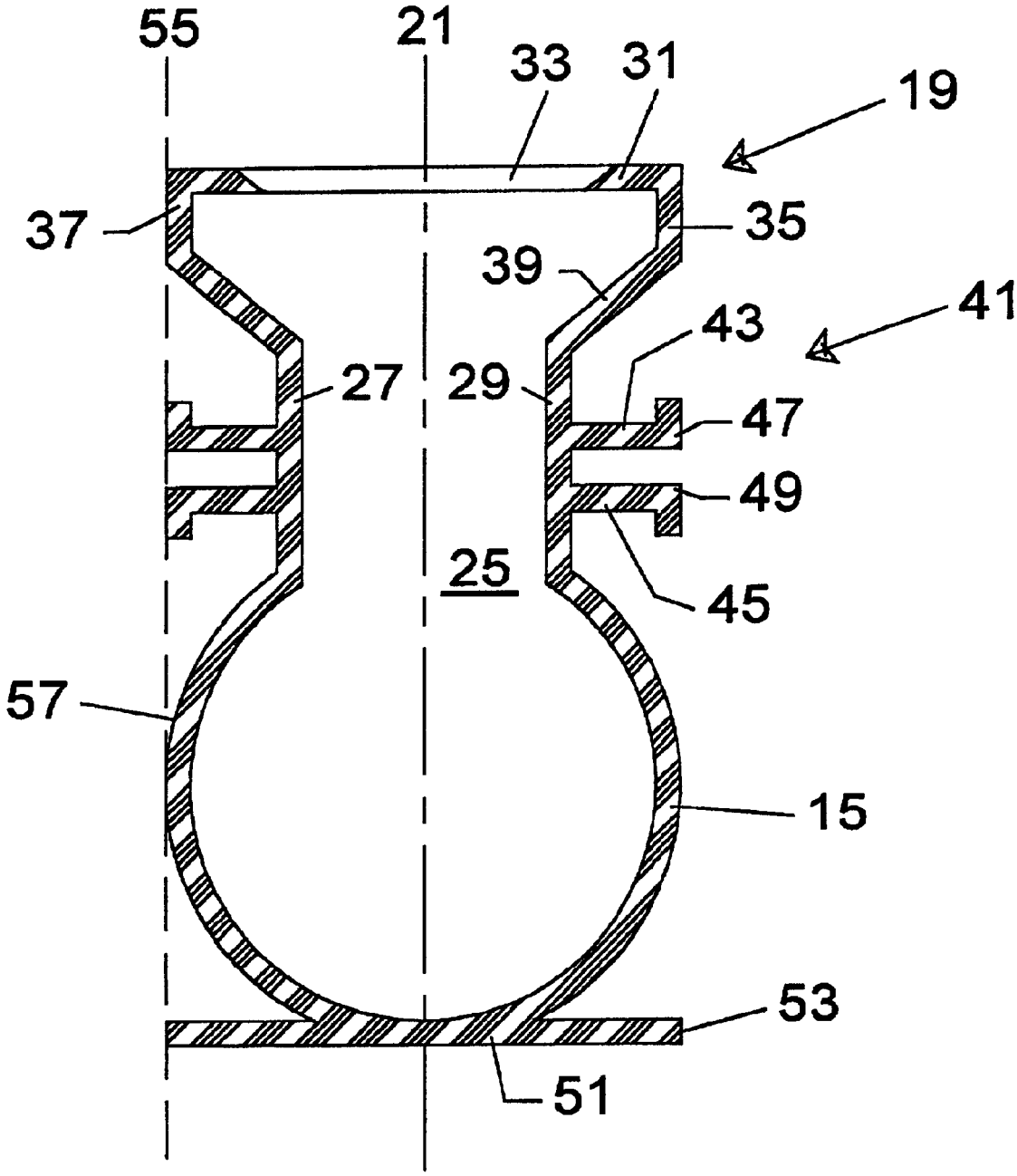
FIG. 2 is an end-on cross-sectional elevation thereof, as seen along line 2—2 in FIG. 1.

The deck drain 11 of the invention is an elongated conduit 13 as seen in FIG. 1, having a cross-sectional profile (FIG. 2) that defines three connected sections: a main channel 15, a mid section 17 and a top section 19. The deck drain 11 is preferably fabricated from extrusion molded polyvinyl chloride or polyethylene, but other materials can be used, including fiberglass and aluminum. The main channel 15, the mid section 17, and the top section 19 are aligned along a major axis 21 running transverse with and intersecting the main channel centerline 23. The cross sectional profile of the conduit 13 does not need to be symmetrical about the major axis 21, but symmetry is preferred and shown. It should be understood that discussion of the elements on one side of the major axis 21 will apply to corresponding elements on the other side of the major axis 21 as well.

The main channel 15 is circular in shape, with an opening 25 at the top to allow water to enter from the mid section 17. The main channel's inside diameter is sized to accept and couple snugly with a piece of one-and-one-half inch Schedule 40 nominal size pipe, and can be varied to fit other pipe sizes. The mid section 17 is made up of two parallel sidewalls 27 and 29 connected to and extending vertically from the main channel opening 25.

The top section 19 has a flat top face 31 designed to be set flush with the surface of the pool decking. A number of slot-shaped openings 33 are defined at periodic intervals along the length of the top face 31. The openings are sized to allow water to drain into the conduit 13 while preventing debris from getting in and clogging the main channel 15. Other opening shapes and configurations can be used, such as an array of round or square holes. If desired, the top face can be made removable to permit cleaning the conduit interior. Vertical faces 35 and 37 connect the top face 31 to a reducer 39 that in turn connects to the mid section 17. Other configurations can be used.

The mid section 17 serves two main purposes: it interconnects the top section 19 and the main channel 15, and it provides a point of attachment for the nail guiding means 41 to be described later. Although the term "nail guiding means" is used, it should be understood that the term applies to screws as well. The length of the mid section can vary, and can be the minimum necessary to attach the nail guiding means. The mid section can even be omitted altogether, and the nail guiding means 41 attached to the top section 19. The nail guiding means 41 are preferably not attached to the main channel, since the nail holes that will inevitably result during installation can provide a path for leakage to the surrounding environment if the nail holes are below the water surface during draining.

Figure 3:
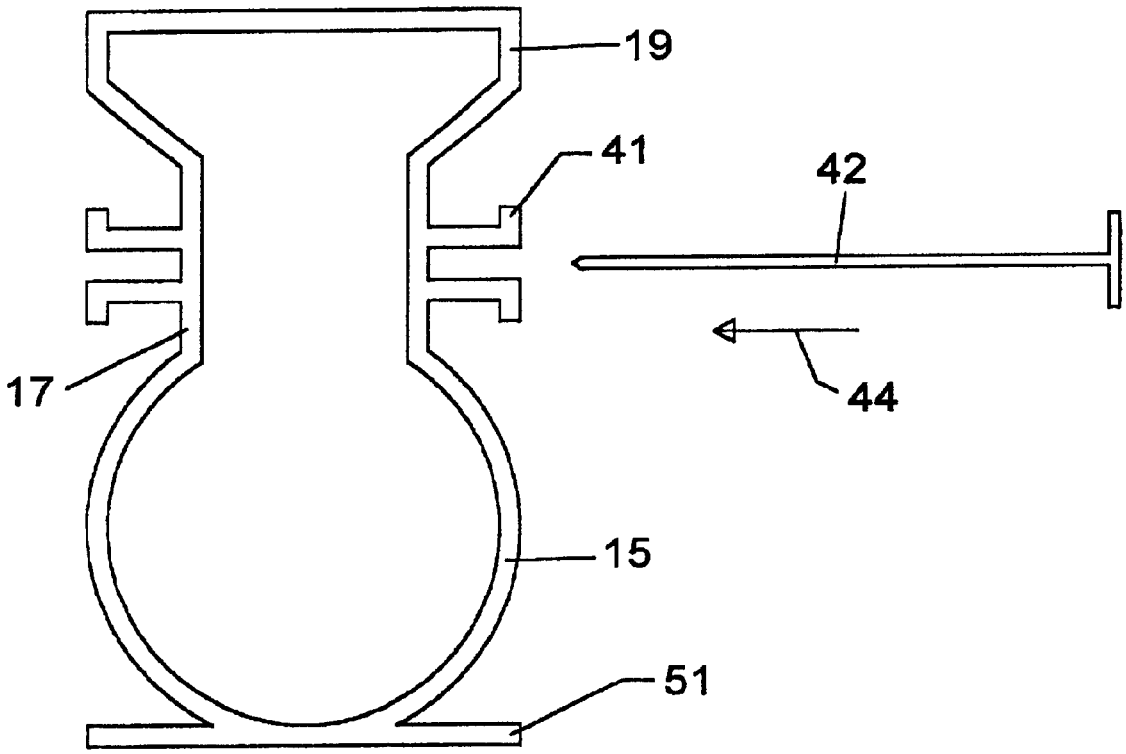
FIG. 3 is an end-on elevation illustrating the use of the nail guiding means.

As shown in FIG. 3, the nail guiding means 41 will retain a nail 42 driven into the conduit 13 in the direction of the arrow 44 in the proper vertical orientation for attachment to a support, and will provide additional structural strength to minimize deformation, misalignment, and cracking of the conduit 13. Preferably, the nail guiding means 41 comprise a pair of parallel projections 43 and 45 extending away from the walls of the mid section 17. Each projection 43 and 45 terminates in a small flange 47 and 49 that serves to strengthen the end of the respective projection 43 and 45 and provide a resting surface for the head of a nail. The projections 43 and 45 are preferably of sufficient length and spaced sufficiently close together to ensure that a nail passing through the projections 43 and 45 on one side of the conduit 13 will pass between the corresponding projections on the opposite side of the conduit 13.

The nail guiding means can have other configurations. For example, tubular projections can be formed in the conduit at regular intervals, rather than the parallel planar projections shown. This configuration has the advantages that substantially less plastic is needed to make the nail guiding means, and that tubular guides will orient the nail properly in both the vertical and horizontal planes, rather than just in the vertical plane as with the preferred embodiment. However, tubular projections cannot be fabricated using normal extrusion molding techniques, and the resulting projections would be prone to breaking off during handling and installation, even with reinforcement.

Figure 4:
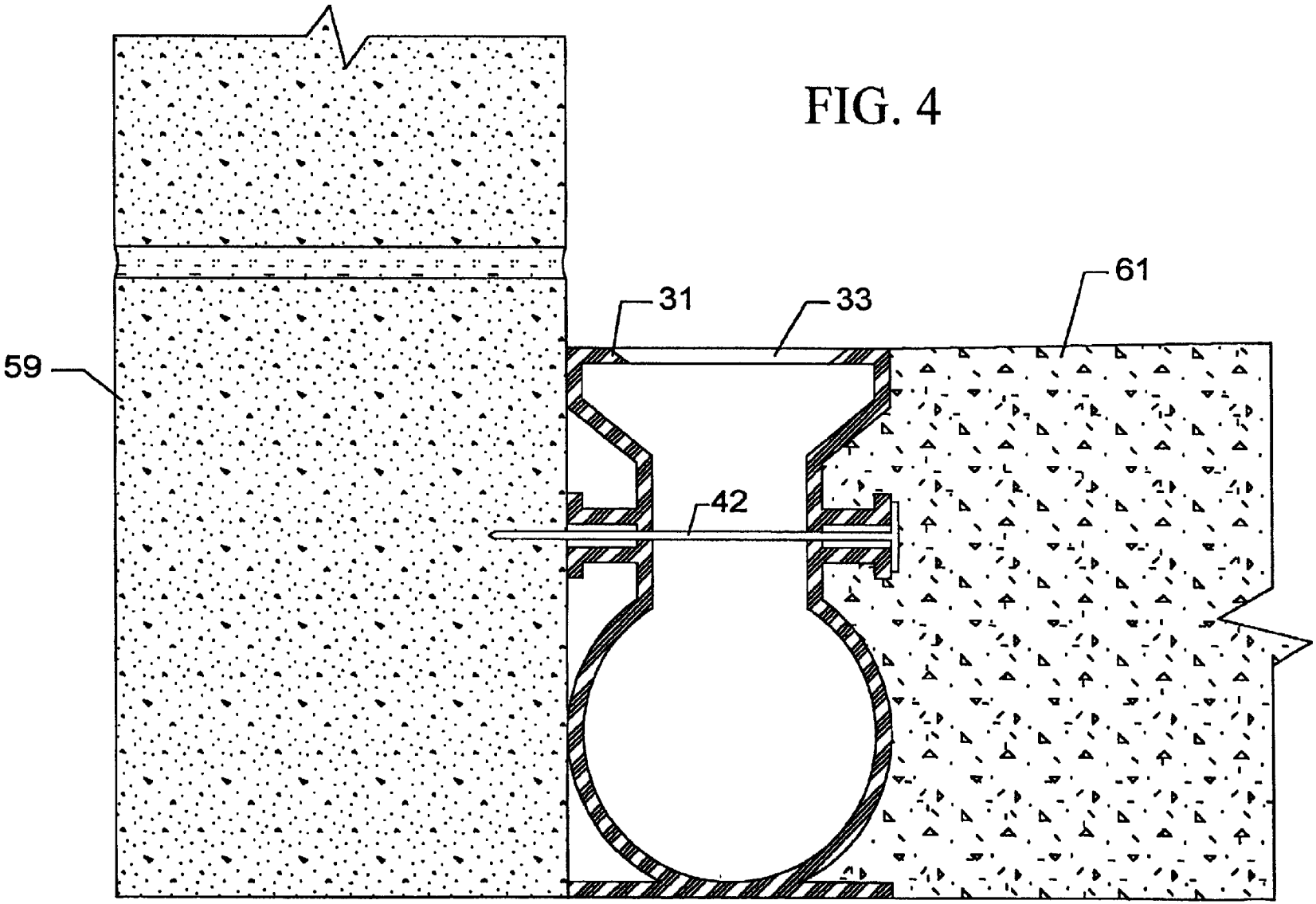
FIG. 4 is a cross-sectional elevation of the deck drain of the invention in a typical installation.

A base plate 51 is tangentially attached to the bottom of the circular main channel 15 and permits the conduit 13 to be set upright on a leveled surface. This provides a convenient means for holding the conduit 13 in place prior to driving nails or screws through the nail guiding means 41. Preferably, the end 53 of the base plate 51, the projection flanges 47 and 49, and the top channel's vertical wall 35 or 37 are all aligned along a vertical axis 55, so that the conduit 13 will contact a vertical support face without wobbling, as shown in FIG. 4. If desired, the outer surface 57 of the main channel 13 can also align along the vertical axis 55. All the elements just listed need not be aligned along the vertical axis 55, but the top section vertical wall 35 or 37 will always be one of the aligned elements, since the top face 31 must abut the vertical support face in order to prevent water from draining around the conduit 13 into the surrounding environment. FIG. 4 illustrates a typical installation for the deck drain 11 of the invention, where the conduit 13 is secured against a cement block 59 with nails 42 and a concrete deck 61 is then poured in against the exposed side of the conduit 13.

The invention has several advantages over the prior art. The deck drain can be constructed simply and inexpensively using conventional methods. It is extremely rugged and durable. It provides means for the conduit to be secured with nails or screws without the deformation and misalignment of prior designs.

The invention has been shown in one embodiment, with alternative embodiments described in the text. It should be apparent to those skilled in the art that the invention is not limited to these embodiments, but is capable of being varied and modified without departing from the scope of the invention as set out in the attached claims.

What is claimed is:

1. A deck drain comprising:

an elongated conduit having a cross-sectional profile defining a top section, and a main channel having a centerline; and nail guiding means comprising a pair of parallel planar projections attached to and extending from the top section.

2. A deck drain as recited in claim 1, further comprising a mid section connecting the top section to the main channel along a major axis transverse to the main channel centerline.

3. A deck drain as recited in claim 2 wherein the main channel has a substantially circular cross section; further comprising a base plate tangentially attached to the main channel transverse to the major axis; wherein the top section and the pair of parallel planar projections, the main channel, and the base plate align along a vertical axis to allow the deck drain to be attached securely to a planar surface along the vertical axis.

4. A deck drain as recited in claim 3, wherein the top section has a top face defining a plurality of openings for allowing fluid to flow into the main channel.

5. A deck drain as recited in claim 3, further comprising a flange attached to the end of each parallel planar projection distal to the mid section.

6. A deck drain comprising:

an elongated conduit having a cross-sectional profile defining a top section;

a main channel having a centerline, and a mid section connecting the top section to the main channel along a major axis transverse to the main channel centerline; and a pair of parallel planar projections attached to and nail guiding means extending from the elongated conduit, the planar comprising projections being parallel to a plane substantially transverse to the major axis.

7. A deck drain as recited in claim 6 wherein the main channel has a substantially circular cross section; further comprising a base plate tangentially attached to the main channel transverse to the major axis; wherein the top section and the pair of parallel planar projections, the main channel, and the base plate align along a vertical axis to allow the deck drain to be attached securely to a planar surface along the vertical axis.

8. A deck drain as recited in claim 6, further comprising a flange attached to the end of each parallel planar projection distal to the mid section.

9. A deck drain as recited in claim 6, wherein the top section has a top face defining a plurality of openings for allowing fluid to flow into the main channel.

10. A deck drain comprising:

an elongated conduit having a cross-sectional profile defining a top section, a main channel having a centerline, and a mid section connecting the top section to the main channel along a major axis transverse to the main channel centerline;

a pair of parallel, substantially identical planar projections attached to and extending from the top section, the planar projections being parallel to a plane substantially transverse to the major axis; and a base plate tangentially attached to the main channel;

wherein the top section, the projections, the main channel and the base plate all align along a vertical axis to allow the deck drain to be attached securely to a planar surface along the vertical axis.

* * * * *